United States Patent [19]

Look et al.

[11] Patent Number: 4,955,822

[45] Date of Patent: Sep. 11, 1990

[54] TWO WAY EXTENSION CORD

[76] Inventors: Robert O. Look; Deborah M. Pittman, both of 624 Easy St., Holly Hill, Fla. 32117

[21] Appl. No.: 461,823

[22] Filed: Jan. 8, 1990

[51] Int. Cl.[5] ..... H01R 19/16

[52] U.S. Cl. ..... 439/505; 439/501

[58] Field of Search ..... 439/505, 502, 638, 640, 439/501

[56] References Cited

U.S. PATENT DOCUMENTS 2,976,524 3/1961 Wall ..... 439/502
3,049,688 8/1962 Sinopoli .
3,290,453 12/1966 Jensen .
3,403,371 9/1968 Mitcham ..... 439/505
3,890,836 6/1975 McKenzie et al. ..... 439/502
4,083,621 4/1978 Davidson .

*Primary Examiner*—Gary F. Paumen

[57] ABSTRACT

A two-way electrical extension cord that includes two cord sections connected to a single male plug. The free ends of the cord sections are attached to female plugs that are designed to electrically mate with electric appliances, such as lamps, coffee makers, power drills, etc. Conductor wires in the separate cord sections are in electrical parallelism with each other so that the single male plug feeds current to both sets of wires.

5 Claims, 1 Drawing Sheet

TWO WAY EXTENSION CORD

BACKGROUND AND SUMMARY OF THE INVENTION

This invention relates to an electrical extension cord, and especially to an extension cord having two divergent cord sections connected to a centrally located electrical plug.

Very often it is necessary to use two extension cords when it is desired to electrically energize separate electrical appliances located at different points in a room. One example would be a situation where two electric lamps are located on end tables at opposite ends of a couch. Another example would be the case where it is desired to operate an electric bread toaster and electric coffee maker at different points on a kitchen counter. A similar situation occurs in the basement workshop where the homeowner desires to operate an electric saw and an electric drill to complete a carpentry project.

The conventional approach is to use two separate extension cords to deliver electrical power to the individual electric appliances. Each extension cord has a multi-pronged male plug adapted for insertion into a wall outlet, and a female plug adapted for connection to an electrical appliance.

My invention relates to a two-way extension cord wherein two cord sections are connected to a single male plug that is adapted for insertion into a wall outlet. The free end of each cord section has a female plug thereon adapted to be connected to an electrical appliance.

One advantage of the present invention is that there may be cost reduction, due to the fact that only one male plug is used. The cost of the other (unused) plug is avoided.

Another advantage of the proposed two-way extension cord is that one of the cord sections can serve as a standby extension cord for future use, e.g. where the need for one of the extension cord sections is either intermittent or unanticipated at the moment. When the need for the second extension cord arises the cord is immediately available. The homeowner does not have to search for an existing extension cord in the home or make a trip to the store to purchase a new extension cord.

Another possible advantage of the proposed extension cord is the fact that the single male plug has only one set of electrical prongs. The single plug can be readily inserted into a single wall outlet whereas it might be difficult or impossible to insert two plugs into a dual wall outlet, due to the plugs being oversize and/or incompatible from a physical clearance standpoint. As a related point, the single plug may be more resistant to inadvertent dislocation from the wall outlet; sometimes with conventional arrangements one plug may bump against the other plug, to cause both plugs to become disconnected from the dual wall outlet.

THE DRAWINGS

FIG. 1 is taken on line 1—1 in FIG. 2.

DESCRIPTION OF A PREFERRED EMBODIMENT OF THE INVENTION

Figure 3:
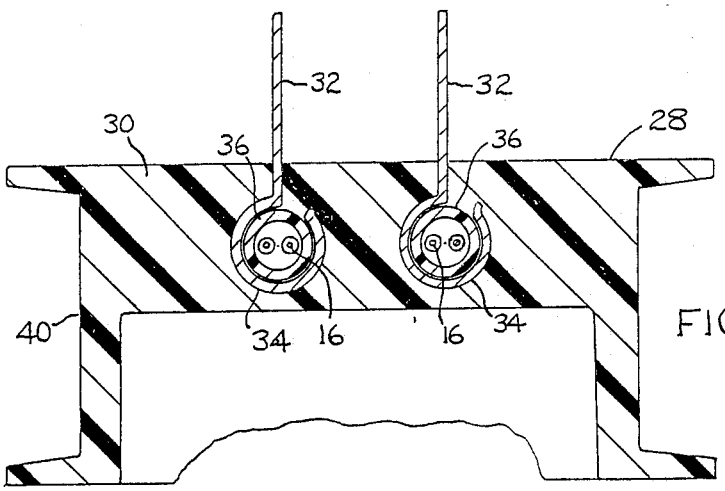
FIG. 3 is a sectional view on line 3—3 in FIG. 2.
Figure 2:
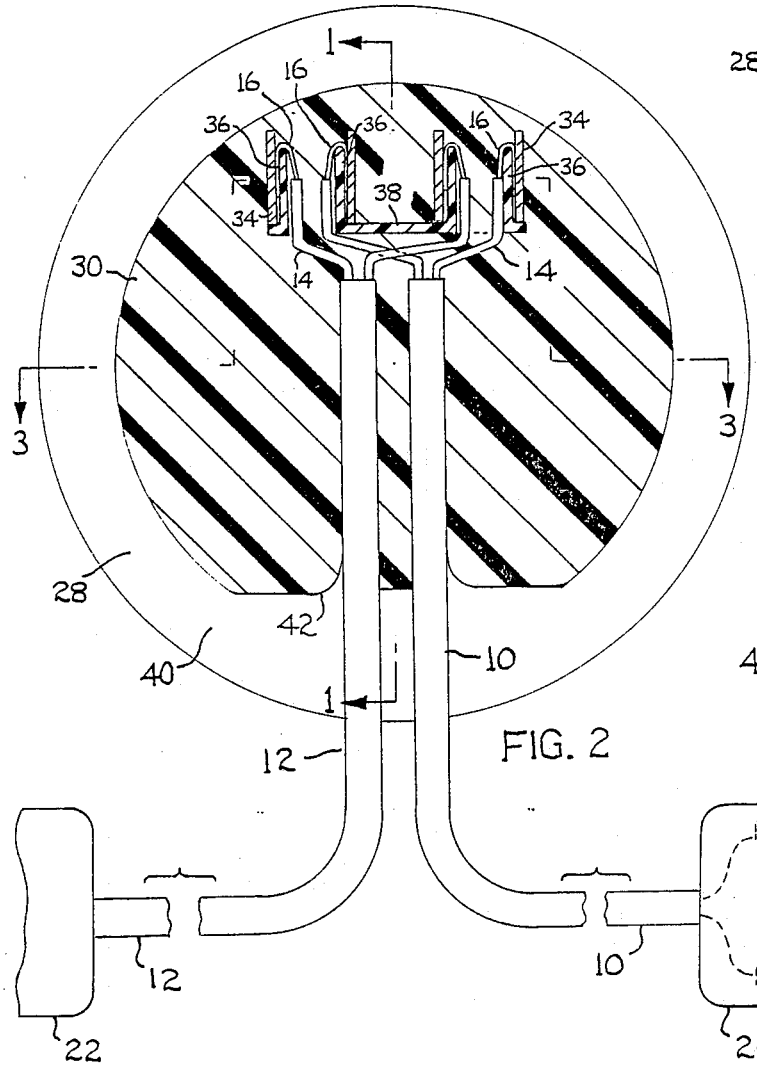
FIG. 2 is a sectional view on line 2—2 in FIG. 1.
Figure 1:
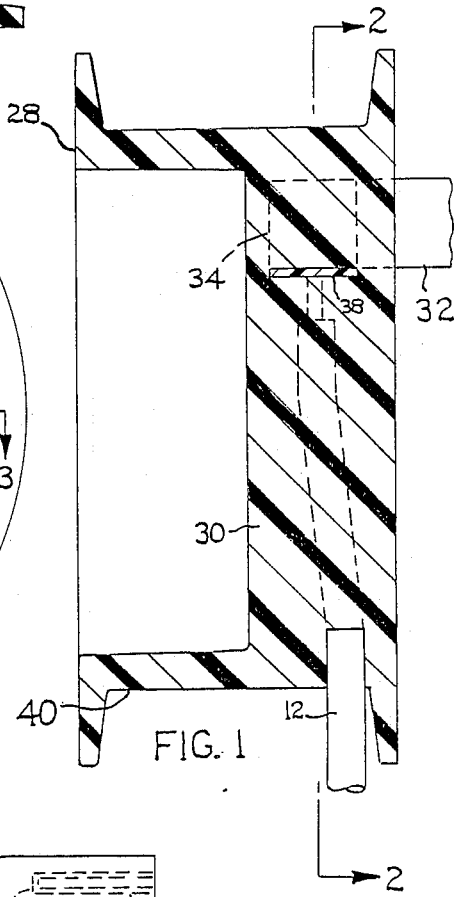
FIG. 1 is a sectional view of an apparatus embodying the invention.

The drawings show an extension cord that comprises two flexible cables 10 and 12. Each cable includes an outer flexible covering formed of an insulating (dielectric) material, and two individually insulated wire conductors. In FIG. 2 the insulation on the upper ends of the wires is designated by numerals 14; the exposed wire ends are designated by numerals 16. The wires may be of multi-strand construction.

The lower ends of cables 10 and 12 are connected to conventional female electrical plugs 20 and 22. Each of these plugs is formed of a dielectric material, in which are embedded two electrical sockets 24. The lower ends of the wire conductors within cables 10 and 12 are connected to the electrical sockets. Plugs 20 and 22 are adapted to be connected to electrical appliances, such as lamps, radios, power drills, etc.

The upper ends of cables 10 and 12 extend into a single male electrical plug 28, that comprises a dielectric housing 30 and two electrically conductive prongs 32. Each prong includes a circular sleeve section 34 that extends around two hollow tubular sections 36 forming parts of a mandrel 38.

Prior to molding the plug housing 30 around prongs 32 and cables 10 and 12, the free ends of the wire conductors are connected to the electrical prongs. The wire ends 16 are passed upwardly through tubular sections 36 of mandrel 38, after which the extreme ends of the wires are reversely turned to extend downwardly along the outer side surfaces of tubular sections 36. The electrical prongs are then positioned so that the inner surfaces of sleeve sections 34 exert clamp forces on the reversely turned wire ends. The process of molding housing 30 encapsulates the electrical prongs and associated cables into an operative condition.

The electrical connections between wire ends 16 and prongs 32 are such that one wire in each cable (10 or 12) connects with one prong, and the other wire in each cable connects with the other prong. Therefore, the two wires in one cable are in electrical parallelism with the two wires in the other cable. The single set of prongs 32, 32 is effective to electrically energize the wires in both cables 10 and 12.

The system shown in the drawings is a two-wire system (ungrounded). The invention could also be utilized in a three-wire grounded system. In that case each cable would have a third ground wire; plug 28 would have a third ground terminal (prong).

Each cable 10 or 12 can have any convenient length, e.g. ten feet. In many cases each female plug 20 or 22 will be connected to an electrical appliance. However, in some cases one of the plugs would not be so connected, because there is no requirement at the moment or because the connection requirement may be temporary or intermittent. It is desirable that the cable not in current use be stored in a compact form, rather than extending loosely along the floor and possibly out into the room whereby it might present a safety problem.

Plug 28 has an endless circumferential groove 40 extending therearound. The unused cable (10 or 12) can be coiled around plug 28 within groove 40, to a wound-up condition; the groove surface forms a reel structure that facilitates compact storage of the unused cable in coiled form.

The two cables 10 and 12 are arranged so that each cable extends vertically downwardly from prong elements 32 through a plug undersurface 42. With such a cable orientation the weight of the cable exerts a downward force on prongs 32; the rear surface of housing 30 seats against the wall outlet surface such that prongs 32 are not likely to work loose form the associated socket openings in the wall outlet. Also, the cables are located behind groove 40 where they do not interfere with the process of coiling the unused cable around the plug 28 circumference.

When plug 28 is used with a dual outlet (i.e. an outlet having two sets of electrical sockets), prongs 32 will be inserted into the lower socket openings. Prongs 32 are located near the upper surface of plug housing 30, such that the plug 28 structure does not obstruct the upper socket openings of the dual outlet.

The drawings show one specific form that the invention can take. It will be appreciated that the invention can be practiced in other forms and configurations.

We claim:

1. A two way electrical extension cord comprising: two flexible electrical cables, each having at least two insulated wires running internally therealong, the wires of one cable not being directly attached to the wires of the other cable; each cable having first and second ends; each wire having first and second ends located at the corresponding ends of the associated cable;

a female electrical plug attached to the first end of each cable, each plug comprising two insulated electrical socket elements electrically connected to the first ends of the wires in the associated cable;

a single male electrical plug comprising a dielectric housing and two insulated electrical prong elements extending therefrom;

said electrical cables having their second ends extending into said dielectric housing; one wire in each cable having its second end electrically connected to one prong element, the other wire in each cable having its second end electrically connected to the other prong element, whereby the wires in one said cable are in electrical parallelism with the wires in the other cable.

2. The two way extension cord of claim 1, wherein the prong elements and the second ends of the cables are permanently encapsulated within the male plug.

3. The two way extension cord of claim 2, and further comprising a dielectric mandrel having two hollow sections, each hollow section being adapted to receive therethrough the second ends of two associated wires, said prong elements having sleeve sections adapted to fit over the hollow sections of the mandrel to electrically connect with the second ends of the wires.

4. The two way extension cord of claim 2, wherein said male plug has an endless circumferential groove therearound, said groove being adapted to serve as a reel structure for storage of either cable in a coiled condition.

5. The two way extension cord of claim 2, wherein said male plug has an undersurface located directly below the prong elements; said electrical cables extending vertically downwardly from said prong elements through the plug housing undersurface.

* * * * *